US008774991B1

(12) United States Patent
Nishinaga et al.

(10) Patent No.: US 8,774,991 B1
(45) Date of Patent: Jul. 8, 2014

(54) SYSTEM AND METHOD OF CONTROLLING VEHICLES TO FOLLOW A DEFINED TRAJECTORY IN A COMPLEX TRACK NETWORK

(75) Inventors: Eugene Iwao Nishinaga, San Rafael, CA (US); Kevin Kohei Nishinaga, San Rafael, CA (US)

(73) Assignee: Cybertran International Inc., Richmond, CA (US)

( * ) Notice: Subject to any disclaimer, the term of this patent is extended or adjusted under 35 U.S.C. 154(b) by 248 days.

(21) Appl. No.: 13/323,774

(22) Filed: Dec. 12, 2011

Related U.S. Application Data

(63) Continuation-in-part of application No. 13/218,422, filed on Aug. 25, 2011, and a continuation-in-part of application No. 13/218,423, filed on Aug. 25, 2011, and a continuation-in-part of application No. 13/218,429, filed on Aug. 25, 2011, and a continuation-in-part of application No. 13/218,434, filed on Aug. 25, 2011, now Pat. No. 8,554,397.

(60) Provisional application No. 61/459,247, filed on Dec. 10, 2010.

(51) Int. Cl.
*G05D 1/00* (2006.01)
*G05D 3/00* (2006.01)
*G06F 7/00* (2006.01)

(52) U.S. Cl.
USPC ..... 701/19; 701/23; 303/177

(58) Field of Classification Search
USPC ..... 701/19, 20, 29, 425, 23; 340/905, 994; 303/177
See application file for complete search history.

(56) References Cited

U.S. PATENT DOCUMENTS

| | | | | |
|---|---|---|---|---|
| 3,828,236 | A * | 8/1974 | Close | 318/561 |
| 5,487,516 | A * | 1/1996 | Murata et al. | 246/182 C |
| 7,092,894 | B1 * | 8/2006 | Crone | 705/7.26 |
| 7,386,391 | B2 * | 6/2008 | Morariu et al. | 701/117 |
| 7,606,624 | B2 * | 10/2009 | Cullen | 700/29 |
| 7,906,862 | B2 * | 3/2011 | Donnelly et al. | 290/6 |

(Continued)

OTHER PUBLICATIONS

Nishinaga, et al., "A Vehicle Collision Avoidance System Using Time Multiplexed Hexadecimal FSK", Boeing Aerospace Company, IEEE/Vehicular Technology Conference, vol. 33, 1983, pp. 171-182.

(Continued)

*Primary Examiner* — Tuan C. To
*Assistant Examiner* — Isaac Smith
(74) *Attorney, Agent, or Firm* — Pillsbury Winthrop Shaw Pittman LLP

(57) ABSTRACT

The present invention relates generally to ground transportation systems. According to certain aspects, the present invention includes systems and methods that provide a higher degree of precision and a greater coordination of vehicle movement than is possible in conventional systems. For example, a control system according to the invention is designed to enforce vehicle movement along a route to a position versus time trajectory. The control system includes control equipment on the vehicle that reports its location on the track every 0.5 seconds. The controlling computer in the station receives the report, and knowing where the vehicle should be and how fast it should be traveling at that point in time via a run definition table prepared for the route, calculates a position and velocity error, and then calculates and sends a tractive effort (force) adjustment command to the vehicle that attempts to reduce the position and velocity error.

16 Claims, 8 Drawing Sheets

(56) References Cited

U.S. PATENT DOCUMENTS

| | | | | |
|---|---|---|---|---|
| 2007/0219681 | A1* | 9/2007 | Kumar et al. | 701/19 |
| 2008/0015745 | A1 | 1/2008 | Gaegauf et al. | |
| 2008/0154452 | A1 | 6/2008 | Kapp et al. | |
| 2008/0167767 | A1 | 7/2008 | Brooks et al. | |
| 2009/0299555 | A1* | 12/2009 | Houpt et al. | 701/19 |
| 2010/0114407 | A1 | 5/2010 | Klooster et al. | |
| 2010/0318247 | A1* | 12/2010 | Kumar | 701/20 |
| 2010/0319565 | A1 | 12/2010 | Mobasher | |

OTHER PUBLICATIONS

Burt, HG.P., et al., "Microprocessor Control of Wheel Slip," IEEE, 1985, pp. 19-28.

* cited by examiner

To perform this maneuver, cars A, B, and C have to approach the merge on a very precise position vs. time trajectory.

SYSTEM AND METHOD OF CONTROLLING VEHICLES TO FOLLOW A DEFINED TRAJECTORY IN A COMPLEX TRACK NETWORK

CROSS-REFERENCE TO RELATED APPLICATIONS

The present application is a continuation-in-part of U.S. patent application Ser. No. 13/218,422, filed Aug. 25, 2011. The present application is also a continuation-in-part of U.S. patent application Ser. No. 13/218,423, filed Aug. 25, 2011. The present application is also a continuation-in-part of U.S. patent application Ser. No. 13/218,429, filed Aug. 25, 2011. The present application is also a continuation-in-part of U.S. patent application Ser. No. 13/218,434, filed Aug. 25, 2011. The present application also claims priority to U.S. Provisional Application No. 61/459,247, filed Dec. 10, 2010. The contents of all such applications are incorporated herein by reference in their entirety.

FIELD OF THE INVENTION

The present invention relates to fixed guideway transportation systems, and more particularly to systems and methods for controlling vehicles to follow defined trajectories in such systems.

BACKGROUND OF THE INVENTION

Modern mass rapid transit rail systems are very effective carriers of people. They are generally grade separated systems to enable vehicles to operate unaffected by automobile traffic, and thereby are able to achieve traffic densities otherwise unachievable. They are, however, very expensive. A typical, but conservative order of magnitude system capital cost for a system is approximately $100 million per bi-directional track mile of system, making it difficult for all but the largest and/or most affluent communities and cities to justify and/or afford the cost of new construction. This limitation has the effect of constraining the reach of these systems, and thus limiting the convenience to the users who can only ride the systems to the few locations to which guideway has been constructed. This results in a classic case of Catch 22. The high cost of systems requires a high ridership to justify the cost. However, high guideway costs limit construction and thus the reach of fixed guideway systems. This limits convenience to the riders, making it difficult to achieve the high ridership needed to justify the high cost.

Conventional mass rapid transit rail technology attempts to improve the ratio of benefits per unit cost by focusing on serving the commuting public. This means building systems to achieve very high passenger capacities to major employment centers. An example conventional system is shown in FIG. 1. As shown, conventional systems 110 achieve high capacities by building heavy infrastructure and operating long heavy trains 112 that typically carry a large number of riders to the few large employment centers that they can most effectively service, while bypassing smaller towns or communities. This, however, requires very costly guideway 122 and station structures 124, which limits the system's reach and thus convenience for the users, especially for those who want to travel to the generally more widely distributed retail, residential, or recreational destinations.

With guideway 122 and station structures 124 that must be built to handle long heavy trains 112 to support demand during commute hours, the result is an expensive but marginally justifiable solution for commute hour travel which is far too expensive to justify for other periods of the day and other destinations.

Other existing transportation systems that aim to be less expensive to build and operate include automated people mover (APM) systems, such as those operating in many modern airports and some cities. These systems are low speed/low capacity systems that operate driverless vehicles at speeds in the range of 25 to 30 mph and achieve line capacities in the range of 2,000 to 3,000 passengers per hour per direction. Given the limited speed and capacity of these systems, even with the somewhat lower cost of construction due to the use of smaller vehicles, the benefit per cost is still poor. Furthermore, with the lower speeds and line capacities, these systems are limited in utility to local service routes.

Another type of transportation system that has been discussed is called "personal rapid transit" (PRT). PRT's differ from the more common APM systems in that these systems are built with offline stations which allow higher traffic densities to be achieved. Typically these systems operate driverless cars that seat four to six people and can provide service on a personal demand-driven basis. However, with the very small cars, high speeds are difficult to achieve and line capacities are severely restricted. There is one PRT that is operating at West Virginia University, the Morgantown PRT, which is an 8.2 mile long system having cars that seat 20 people. With a claim of 15 second headways, a line capacity of 4,800 passengers per hour per direction can be achieved. With rubber-tired vehicles, however, the top speed of the system is 30 mph thus limiting its applicability to low speed local service lines.

Co-pending application Ser. No. 13/218,422, the contents of which are incorporated by reference in their entirety, dramatically advanced the state of the art by providing a fixed guideway transportation system that can overcome many of the above and other challenges of the prior art. For example, the system of the co-pending application includes driverless vehicles carrying 10 to 30 persons designed for optimal ratio of benefits per cost. However, certain challenges remain.

For example, in order to cost effectively build and operate a system that operates smaller vehicles such as those contemplated by the co-pending application, yet achieves line capacities that justify the cost of constructing track infrastructures, the density of traffic that can be achieved needs to be sufficiently high. That means that safe operating headways must be made smaller than those achievable with conventional control systems that represent today's state of the art. Furthermore, these safe operating headways should be achieved at mass rapid transit speeds (at least 60 mph). This cannot be achieved with current systems.

Safe operation further requires that vehicles must always be able to stop before arriving at obstacles on the track. With all track geometries (i.e. grade, track curvature, etc.) being equal, the greatest restriction will occur where there are fixed obstacles (i.e. zero speed obstacles) in the path of the vehicle. Therefore, in order to achieve high traffic densities, it is desirable to eliminate the existence of fixed location obstacles on the track, such as switch points between tracks.

Relatedly, since a collision between two vehicles is a life-threatening event, control functions that prevent collisions are critical to safety. In the rail industry, control that is critical to safety must be designed and implemented to a standard commonly referred to as "vital." In recent years achieving vital status has required an analytical demonstration of a Mean Time Between Unsafe Event or Hazard (MTBH) of $10^9$ hours or greater. Accordingly, any methodology aimed at increasing traffic density by removing fixed obstacles such as track switches should include collision protection satisfying this standard.

When smaller, lighter vehicle are made to operate on smaller track structures, more complex track routes become possible as systems that reach deeper into communities can be constructed. Driverless operation on complex track networks require the management of traffic through many merges and diverging track routes. This requires a higher degree of precision and a greater coordination of vehicle movement. Accordingly, there remains a need in the art for methods and systems that enable this level of control.

SUMMARY OF THE INVENTION

The present invention relates generally to ground transportation systems, and more particularly to a fixed guideway transportation system that achieves a superior cost benefit ratio, is lower in net present cost and thus more easily justified for lower density corridors, and can provide passenger carrying capacities appropriate for higher density corridors serviced by mass rapid transit systems today. According to certain aspects, the present invention includes systems and methods that provide a higher degree of precision and a greater coordination of vehicle movement than is possible in conventional systems. For example, a control system according to the invention is designed to enforce vehicle movement along a route to a position versus time trajectory. The control system includes control equipment on the vehicle that reports its location on the track every 0.5 seconds. The controlling computer in the station receives the report, and knowing where the vehicle should be and how fast it should be traveling at that point in time via a run definition table prepared for the route, calculates a position and velocity error, and then calculates and sends a tractive effort (force) adjustment command to the vehicle that attempts to reduce the position and velocity error.

In accordance with these and other aspects, a method of controlling a vehicle in a transportation system according to embodiments of the invention includes receiving a table that defines a trajectory for the vehicle; developing a current target position for the vehicle; receiving feedback from the vehicle about its actual position; and using the target position and the actual position to develop commands to cause the vehicle to follow the defined trajectory.

In further accordance with these and other aspects, a system for controlling a vehicle in a transportation system according to embodiments of the invention includes a master computer, remote from the vehicle, that creates a table that defines a trajectory for the vehicle; a computer remote from the master computer that: develops current target position for the vehicle; receives feedback from the vehicle about its actual position; and uses the target position and the actual position to develop commands to cause the vehicle to follow the defined trajectory.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

Figure 1:
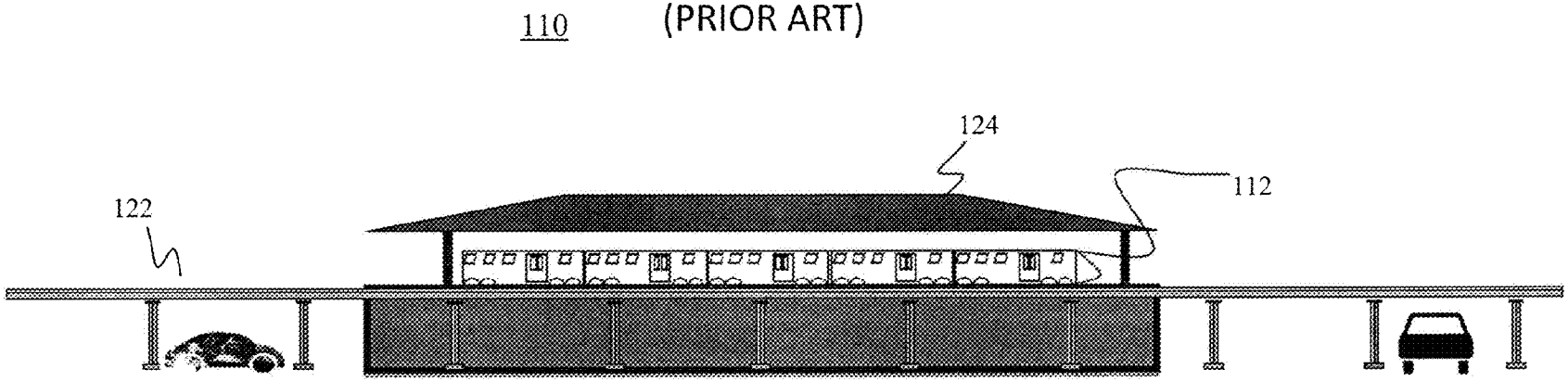
FIGURE 1 (PRIOR ART)
FIG. 1 illustrates a conventional mass transit system.

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

According to certain aspects, the invention of the co-pending application enables the construction of rail lines that: 1. achieve a superior amount of benefits per cost; 2. are lower in cost and thus more easily justified for lower density corridors; and 3. can provide passenger carrying capacities appropriate for higher density corridors serviced by mass rapid transit systems today.

In certain embodiments, these objectives are met by utilizing smaller vehicles that can operate on a less expensive infrastructure. Using certain methods according to the co-pending application, the costs of fixed guideway mass rapid transit systems are reduced, allowing more destinations to be accessed. Also, with certain methods according to the co-pending application, the same structures appropriate for low ridership corridors and/or service hours can be used to achieve passenger carrying capacities needed for the high capacity corridors served today by modern mass rapid transit systems.

According to further aspects, the invention of the co-pending application improves the amount of benefits per cost of rail transit by reducing the cost to levels more justifiable for low density corridors. To be meaningful, certain methods according to the co-pending application achieve improved benefits per cost in a holistic manner, in other words, by reducing the net cost of ownership which includes not only the cost of equipment but also the net cost of operating and maintaining the system.

Although the principles of the inventions of the co-pending application and the present application will be explained in connection with applications to conventional diesel and/or electrified rail systems, the invention is not limited to these types of systems. For example, the principles of the invention can be extended to conventional and other vehicle technologies that do not rely on steel wheels rolling on steel rail.

Figure 2:
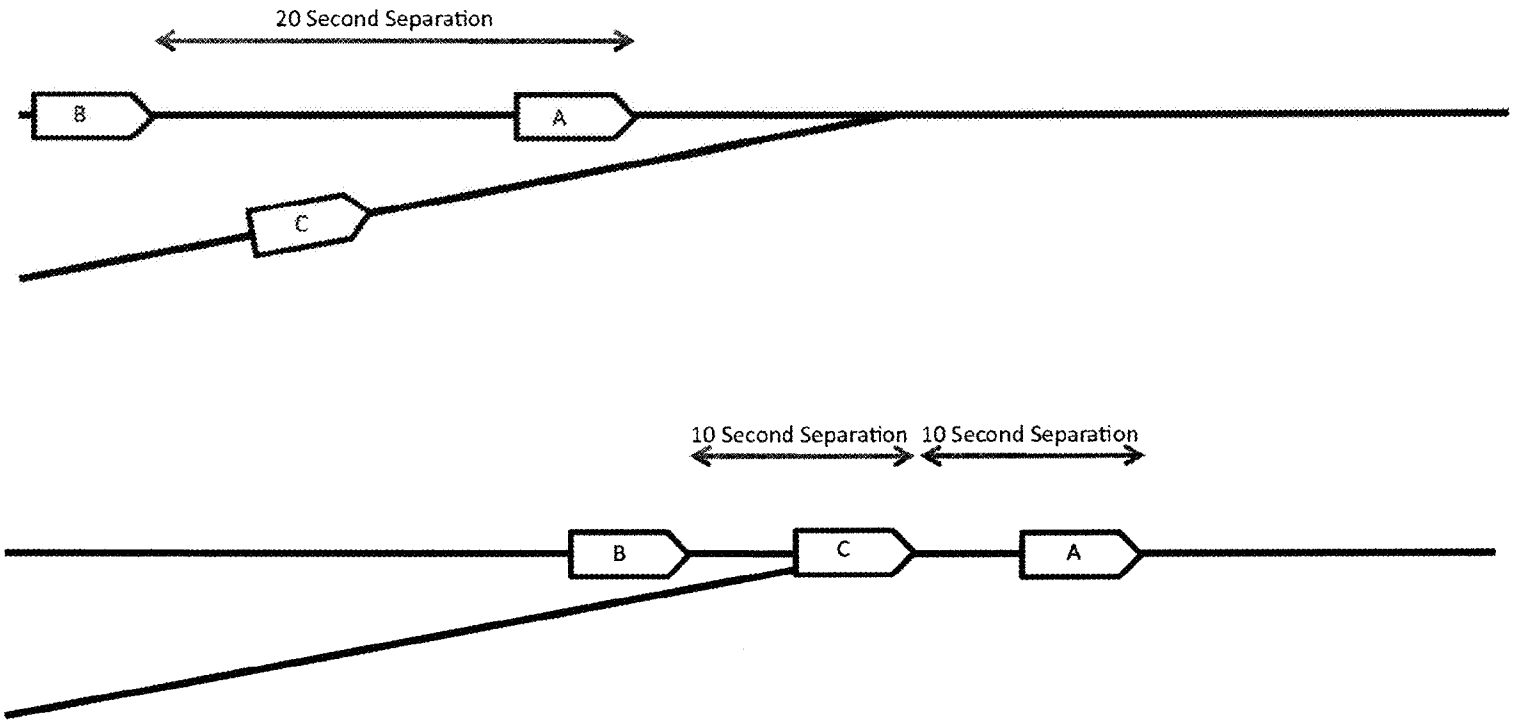
FIG. 2 illustrates aspects of an example method of controlling vehicles according to the invention.

According to certain aspects, the present invention further improves upon the invention of co-pending application Ser. No. 13/218,429. In the system described in the co-pending application, the ability to control vehicles through complex track networks including frequent merging of vehicle traffic is required. This is illustrated in FIG. 2 which depicts a situation where one vehicle is being made to merge onto a line in between two other vehicles arriving at the merge point from a different leg of the merge. The present invention together with co-pending application Ser. No. 13/323,768, the contents of which are incorporated by reference herein, provides one way to perform this operation. In embodiments, a control system according to the invention is designed to enforce vehicle movement in alignment with a pre-defined position versus time trajectory. The control system includes control equipment on the vehicle that reports its location on the track every $t_{frame}$ milliseconds (assume $t_{frame}$=500 ms in this example) and a control computer in the station that, knowing where the vehicle should be at every instant in time, sends tractive effort commands that are calculated in the station to attempt to cause the vehicle to follow the desired position versus time trajectory.

Figure 3:
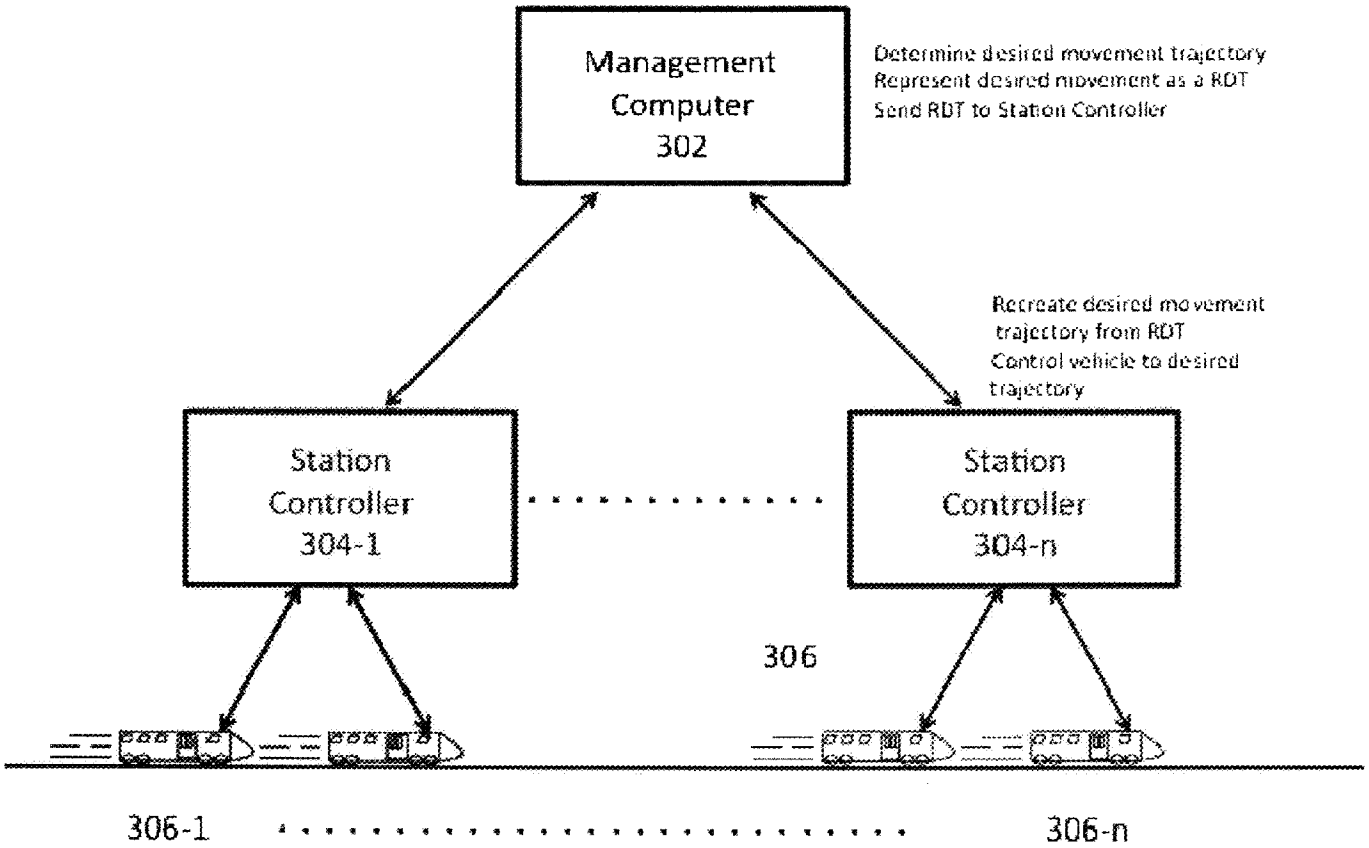
FIG. 3 is a block diagram that illustrates an example control system according to embodiments of the invention.

Certain aspects of the invention will now be explained in connection with FIG. 3. In embodiments, the control is achieved with three layers of control. At the highest level is the management computer 302. It is here where the trajectory is developed and defined. This computer would typically be located at a central dispatch/control facility and is in communication with a multiplicity of station control computers 304 which enforce the trajectory in concert with control equipment in the vehicles 306. Typically, station control computers 304 are distributed throughout a large system and housed in station structures. At the lowest level are the controllers that reside on each vehicle 306. These are interface controllers that serve as the interface between control functions and the physical elements that are the being controlled. The trajectory is defined by "Run Definition Tables" that contain the information necessary for the calculation of the trajectory (position versus time plot). The nature of and one example methodology for creating run definition tables is described in co-pending application Ser. No. 13/323,768. The present disclosure describes one example methodology for using the run definition tables as the basis of control. To note here is that the control of switching and doors are also control functions that can be achieved with run definition tables. However, these methods will not be described in detail for sake of clarity of the invention.

The station computer 304 and the vehicle controller 306 can be implemented by system elements of a communication-based control system such as that described in co-pending application Ser. No. 13/218,429. Those skilled in the art will understand how to adapt the system described in the co-pending application, as well as alternative systems, with the functionality of the present application after being taught by the present disclosure. As mentioned above, it should be apparent that multiple station control computers 304 can be in communication with a given vehicle 306 at any time during its route, requiring hand-off procedures between such computers 304, perhaps in coordination with management computer. However, details thereof will be omitted here for sake of clarity of the invention. According to certain aspects, the present invention includes a method of controlling vehicles to track the trajectories defined by run definition tables. One example control system whereby the control needs set forth above are achieved implements the overall process steps described in more detail below. (Note: As described in co-pending application Ser. No. 13/218,434, additional safety is assured by a separate process referred to as the Collision Avoidance Function, which can be used in conjunction with the present invention.)

Step 1: The management computer 302 uses information about the track and the location and behavior of other vehicles in the system to determine a desired movement trajectory for car n. The desired movement trajectory defines the desired vehicle location in the system for every instant in time.

Step 2: The management computer 302 calculates and develops a table of values, referred to hereafter as a Run Definition Table (RDT), that uniquely represents the desired movement trajectory, but is not of itself a table of position and time values.

Step 3: The management computer 302 sends the RDT for car n to the station control computer 304 where an algorithm is executed that calculates and re-creates the desired movement trajectory originally developed in the management computer 302.

Step 4: The controller in vehicle 306 updates the station control computer 304 with a position report every $t_{frame}$ and the station control computer then compares the reported position with the desired movement trajectory and if the two are not aligned, calculates and sends the vehicle controller 306 a correction command to attempt to cause the vehicle to follow the desired movement trajectory.

An example system and method for creating run definition tables that can be used in the present invention are described in more detail in co-pending application Ser. No. 13/323,768, the contents of which are incorporated by reference herein. According to certain aspects, the present invention is directed to controlling vehicles to follow the trajectory defined by such run definition tables.

In embodiments, a first step in the control of vehicles to a trajectory is the re-creation of the position versus time trajectory described by the contents of the Run Definition Table (RDT) received from the management computer. The following describes an algorithm for re-creation of the trajectory according to embodiments of the invention.

As described more fully in 13/323,768, the Run Definition Table is a table of times and jerk rate values that describes the desired longitudinal movement of the vehicle. It is created in the management computer 302 to represent the desired trajectory and then sent to the station controller 304 where it is used to recreate the desired trajectory. Since the closed loop control of the vehicle attempts to cause vehicle movement to follow the pre-defined location and velocity as a function of time, the station controller must determine from the jerk values contained in the RDT the target location and velocity of the vehicle at each instant of time. Moreover, a correction factor must be calculated in the station and sent to the vehicle to control the vehicle motors to cause the vehicle to follow the desired trajectory.

In embodiments, the target locations and velocities are needed by the station controller every 500 ms when new reports are received from the target vehicle and a new command must be developed to enforce vehicle movement. Thus, the calculation of location and velocity is performed only once every 500 ms. However, in the management computer where the RDT is created, the times at which jerk values change are not developed with any consideration for the times when the station controller will calculate the trajectory information. As a result, the times when the jerk value must change will not, in most cases, synchronize with the times when the trajectory calculation is made. This will introduce an error in the trajectory calculation that likely will be greater than what can be tolerated. It is therefore necessary to account for this lack of synchronization between the times when the RDT defines jerk rate changes and the times when the station controller calculates new position and velocity targets. The pseudo code developed below describes one example method of accounting for this lack of synchronization.

In embodiments, the times in the RDT table are not absolute times but are relative times from the start of each program execution. Therefore, when the station controller is initiated with a given trajectory for a vehicle, the time reported by the system clock will be recorded and used as a reference point from which all relative times will be calculated. This relative time will be the time used when calculating trajectories from the RDT file.

The algorithm described herein divides the task into two steps. The first step updates the time and index variables to reflect the current processing cycle. The second step then calculates the new physical state of the vehicle (i.e. location, velocity, and acceleration) based on the current time's relation to the times contained in the RDT file. This calculation always starts with the state of the vehicle developed during the previous execution of the calculation and adds the change developed from the jerk specified in the RDT over the time during which it is to apply. Since the jerk change times do not necessarily coincide with the station controller execution times, whenever a jerk change boundary is passed, the time during which the prior jerk value applies and the time during which the new jerk value applies must be calculated and the jerk applied appropriately.

Figure 4:
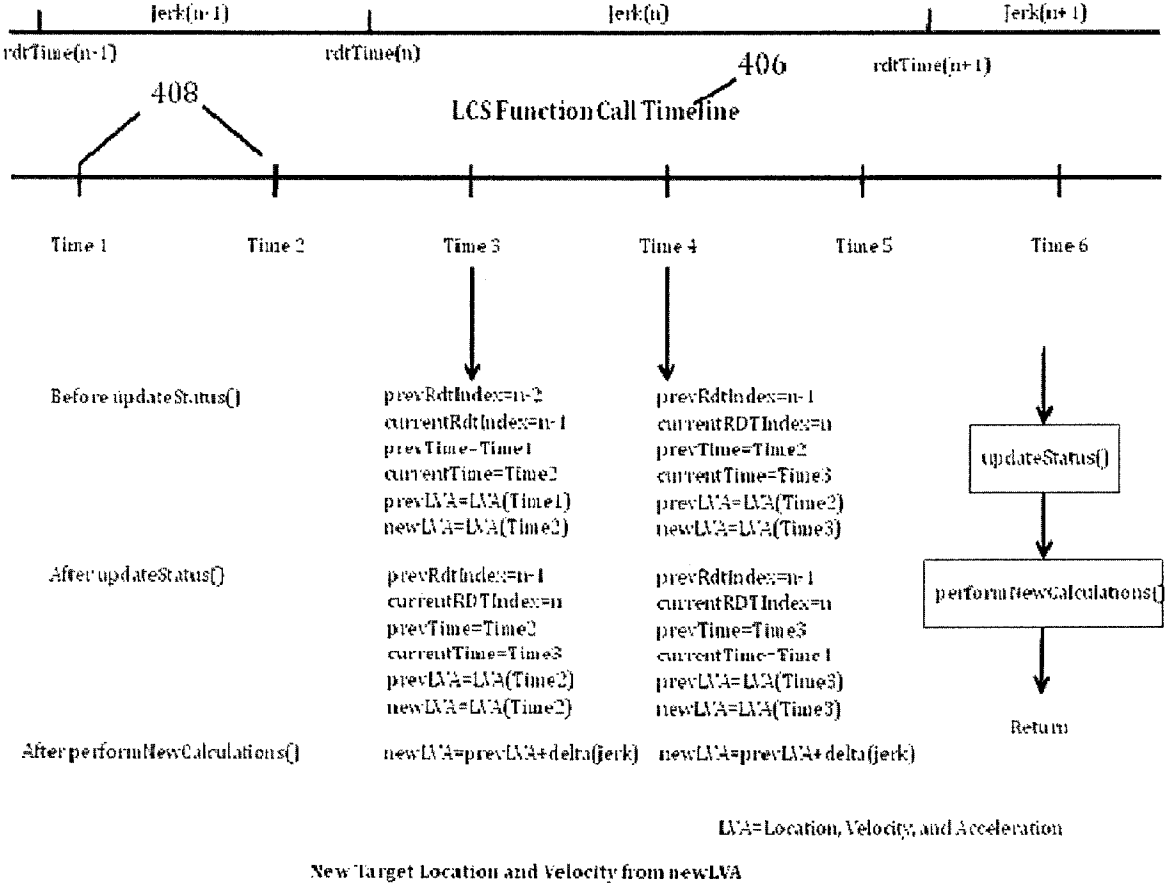
FIG. 4 is a flow diagram illustrating an example algorithm for updating target parameters for a vehicle trajectory according to embodiments of the invention.

One example process for determining the desired vehicle trajectory from a run definition table is illustrated with the following Pseudo Code together with FIG. 4. In FIG. 4, two timelines are shown, of which the one labeled 402 represents the times when the jerk to be applied to the vehicle trajectory are to changed as might be defined in a run definition table. The second time line 406 shows the times when the station controller must calculate the updated position for a given car. If it is assumed for this discussion that the frequency of position updates is every $t_{frame}$=500 ms, the time between each of Time and $Time_{n+1}$ is 500 ms. As shown, the events on the top time line are not synchronized with the events represented on the bottom time line so each rdtTime(n) does not necessarily coincide with any Time n on the bottom line. Referring now to the Pseudo Code, note the code segment following "PERFORM NEW CALCULATIONS." This is executed every 500 ms at the time the station controller is to calculate an updated position for the desired car location. As shown, the program checks first to see if the update time (multiple of $t_{frame}$) coincides with a jerk change boundary 404 on the top timeline. If it does, only one jerk value applies and it is applied to the full 500 ms since the last update. If it does not, then two jerk values must be used, one from before the jerk change boundary 404 and one from after the jerk change boundary 404, and the effective duration of each must be determined. This is accomplished in the procedure determineTwoJerkValuesAndTimes( ). Once the jerk values and the applied duration of each are determined, this information can now be used to calculate a new state (position, velocity, and acceleration) for the vehicle. This is achieved with the procedures calcNewStateWithJerkOne( ) and calcNewStateWithJerkTwo( ) if the update time does not coincide with a jerk change boundary 404 or with calcNewStateWithOneJerkValue( ) if the update time 408 does coincide with a jerk change boundary 404.

Pseudo Code

```
Station Controller Initialization→THIS IS EXECUTED
  ONCE UPON STARTUP OF THE STATION CONTROL-
  LER SOFTWARE
runStartTime=systemClock( )
RUNSTARTLOCATION=[User Input]
TIMEFIELD=0
JERKFIELD=1
Vehicle Specific Initialization→THIS EXECUTED ONCE
  FOR EVERY VEHICLE AT THE START OF VEHICLE
  SPECIFIC PROCESSING
current_time=systemClock( )−runStartTimeReal
current_rdt_index=0
newLocation=RUNSTARTLOCATION
newVelocity=0
newAcc=0
THE FOLLOWING IS EXECUTED ONCE EVERY 500
Ms.
Update Status, Synchronize with Fields in RDT
DO updateStatus( )
  prevTime=currentTime
  currentTime=systemClock( )−runStartTimeReal
  prevLocation=newLocation
  prevVelocity=newVelocity
  prevAcc=newAcc
  IF currentTime>=rdt[currentRdtIndex+1,TIMEFIELD]
  prevRdtIndex=currentRdtIndex
  currentRdtIndex=currentRdtIndex+1
  ENDIF
ENDDO updateStatus( )
Perform New Calculations
DO performNewCalculations( )
  IF    currentTime−RDT[currentRDTIndex,TIMEFIELD]
>=0
  determineTwoJerkValuesAndTimes( )
  calcNewStateWithJerkOne( )
  calcNewStateWithJerkTwo( )
  ELSE
  determineOneJerkValueAndTime( )
  calcNewStateWithOneJerkValue( )
  ENDIF
ENDDO performNewCalculations( )
DO determineTwoJerkValuesAndTimes( )
  //DETERMINE JERK1 AND JERK1 INTERVAL
  jerkOne=rdt[prevRdtIndex, JERKFIELD]
  jerkOneDuration=rdt[prevRdtIndex, TIMEFIELD]−prev-
Time
  //DETERMINE JERK TWO AND JERK TWO INTER-
VAL
  jerkTwo=Rdt[currentRdtIndex, JERKFIELD]
```

```
  jerkTwoDuration=currentTime−rdt[currentRdtIndex,
TIMEFIELD]
ENDDO determineTwoJerkValuesAndTimes( )
DO calcNewStateWithJerkOne( )
  newLocation=prevLocation+prevVel*jerkOneDuration
  +½*prevAcc*jerkOneDuration^2+
⅙*jerkOne*jerkOneDuration^3
  newVel=prevVel+prevAcc*jerkOneDuration+
½*jerkOne*jerkOneDuration^2
  prevAcc=prevAcc+jerkOne*jerkOneDuration
ENDDO calcNewStateWithJerkOne( )
DO calcNewStateWithJerkTwo( )
  newLocation=newLocation+prevVel*jerkTwoDuration
  +½*newAcc*jerkTwoDuration^2+
⅙*jerkTwo*jerkTwoDuration^3
  newVel=newVel+newAcc*jerkOneDuration+
½*jerkOne*jerkOneDuration^2
  newAcc=newAcc+jerkOne*jerkOneDuration
ENDDO calcNewStateWithJerkTwo( )
DO determineOneJerkValueAndTime( )
  oneJerk=rdt[currentRdtIndex, JERKFIELD]
  oneJerkDuration=currentTime−prevTime
ENDDO determineOneJerkValueAndTime( )
DO calcNewStateWithOneJerkValue( )
  newLocation=prevLocation+prevVel*oneJerkDuration
  +½*prevAcc*oneJerkDuration^2+
⅙*oneJerk*oneJerkDuration^3
  newVel=prevVel+prevAcc*oneJerkDuration+
½*oneJerk*oneJerkDuration^2
  prevAcc=prevAcc+jerkOne*oneJerkDuration
ENDDO calcNewStateWithOneJerkValue( )
```

A method according to the example pseudo code and FIG. 4 developed a desired position for the vehicle being controlled at every update time accounting for the unsynchronized time relationship between when the jerk values change in the run definition table and when the update must occur in the control computer. An objective of the control method described below is to cause the vehicle to follow the developed trajectory.

Figure 5:
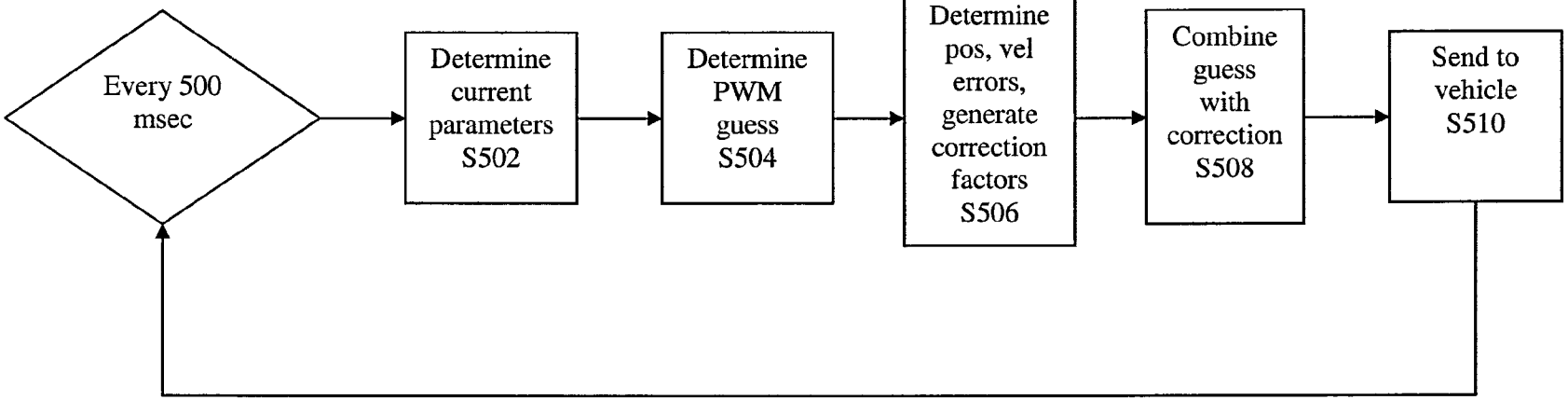
FIG. 5 is a flowchart illustrating an example control methodology used by a station controller to control a vehicle according to aspects of the invention.

In embodiments, a control methodology is explained in connection with FIG. 5. As depicted in FIG. 5, the control method includes two important steps. First, an open loop estimation of the motion command value is calculated in step S504 based on the pre-calculated trajectory. In other words, a determination is made as to the motion command value that will likely cause the vehicle to follow the trajectory assuming a nominal vehicle. Second, closed loop correction values are calculated S506 using feedback data from the actual vehicle movement. The open loop estimation value and the closed loop adjustment values are then combined to form the controlling command to the motor in steps S508 and S510. As discussed earlier, the desired target performance is for tracking the space/time trajectory that has been defined by the RDT developed originally in the management computer 302. This tracking is an important aspect of this invention.

An example methodology for performing step S504, described in more detail in co-pending application Ser. No. 13/323,779, defines how a mathematical function can be created that estimates the force commands that will cause the vehicle to move as defined by the trajectory. An example system according to embodiments of the invention operates vehicles and adjusts motor force commands with a pulse width modulated (PWM) voltage, so the discussion in this section will reference this example. However, those skilled in the art will understand how to implement the principles of the invention in alternative types of systems. In general, the co-pending application describes a method of predicting a PWM command to the vehicle that will achieve a target rate of acceleration at the varying speeds of the vehicle. The end result of the method will be a mathematical expression for PWM (velocity$_{target}$, acceleration$_{target}$), i.e. PWM as a function of the target speed and acceleration defined by the trajectory. (Note: The target speed and acceleration are derived from the target position x(t), i.e.

$$\text{speed} = \frac{dx(t)}{dt}$$

and $$\text{acceleration} = \frac{d^2x(t)}{dt^2}.)$$

Figure 6:
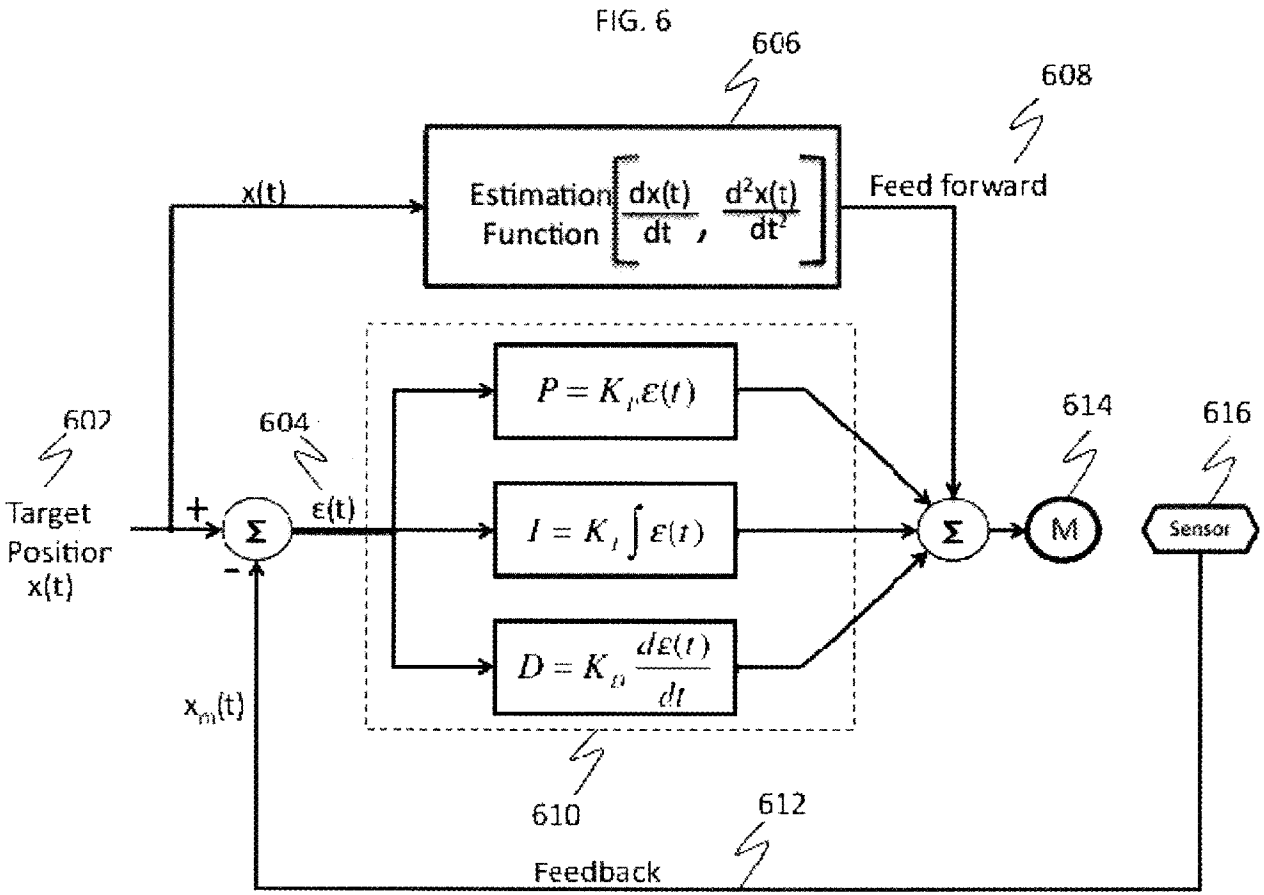
FIG. 6 is a diagram illustrating an example method of developing commands based on a target position derived from the run definition table according to embodiments of the invention.

An example methodology for performing step S506 is further illustrated in schematic form in FIG. 6. Note, in this illustration the feedback correction factors are shown being developed using the commonly used PID control equations 610. There are, in fact, a variety of ways of developing the correction factors, PID controllers being one of many. Examples of such can include fuzzy logic based feedback, neural net based feed back, or even combinations of multiple methodologies. In fact, during experimentation, a variety of methods have been tested with each demonstrating slightly different performance characteristics but all likely being acceptable In FIG. 6, the Target Position 602 is the desired position for the car as developed from the trajectory re-created from the run definition table developed by the management computer. The estimation function 606 uses the successively targeted positions to calculate target velocities and accelerations and then develops a "best guess" PWM command value for driving the motor. This is referred to in FIG. 6 as the feed forward term 608. To account for vehicle behavior that deviates from the intended movement, a sensor 616 in the vehicle 306 is used to provide feedback 612 for comparison with the target position and an error term $\epsilon(t)$ 604 is developed. This is provided to the feedback controller 610, in this illustration, a PID controller, and feedback terms are calculated to be summed together with the feed forward term 608 from the estimation function 606 before delivery to the motor. The end goal of this process is to force the position error to zero which if successful will have the vehicle traveling as defined by the run definition table.

Figure 7:
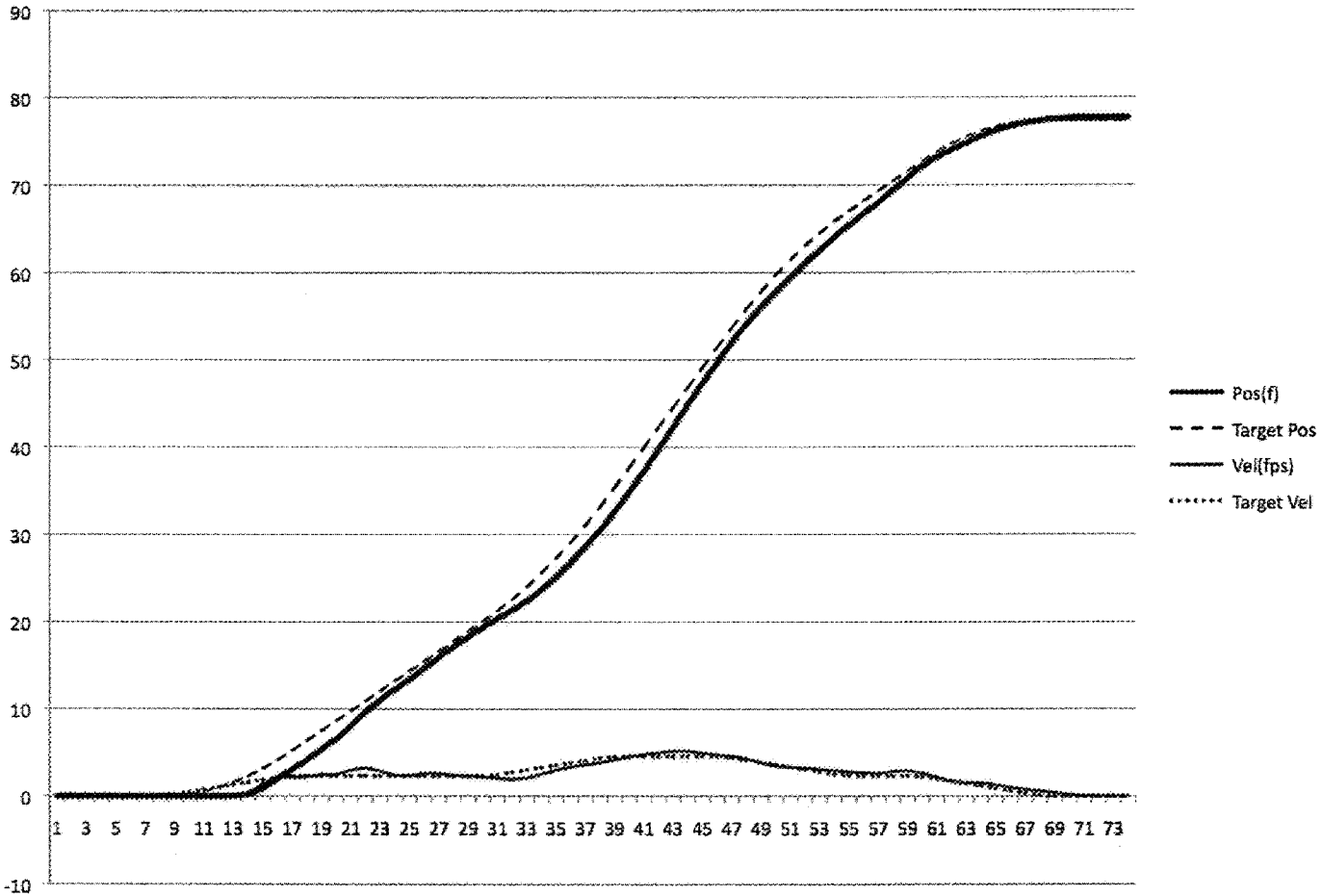
FIG. 7 is a plot illustrating an example performance of a vehicle control methodology according to embodiments of the invention.

FIG. 7 shows a plot from an actual run using the methodology described in the previous paragraphs. As is evident from this plot, when off-tracking occurs, the feedback control attempts to force the vehicle back onto the target trajectory.

Figure 8:
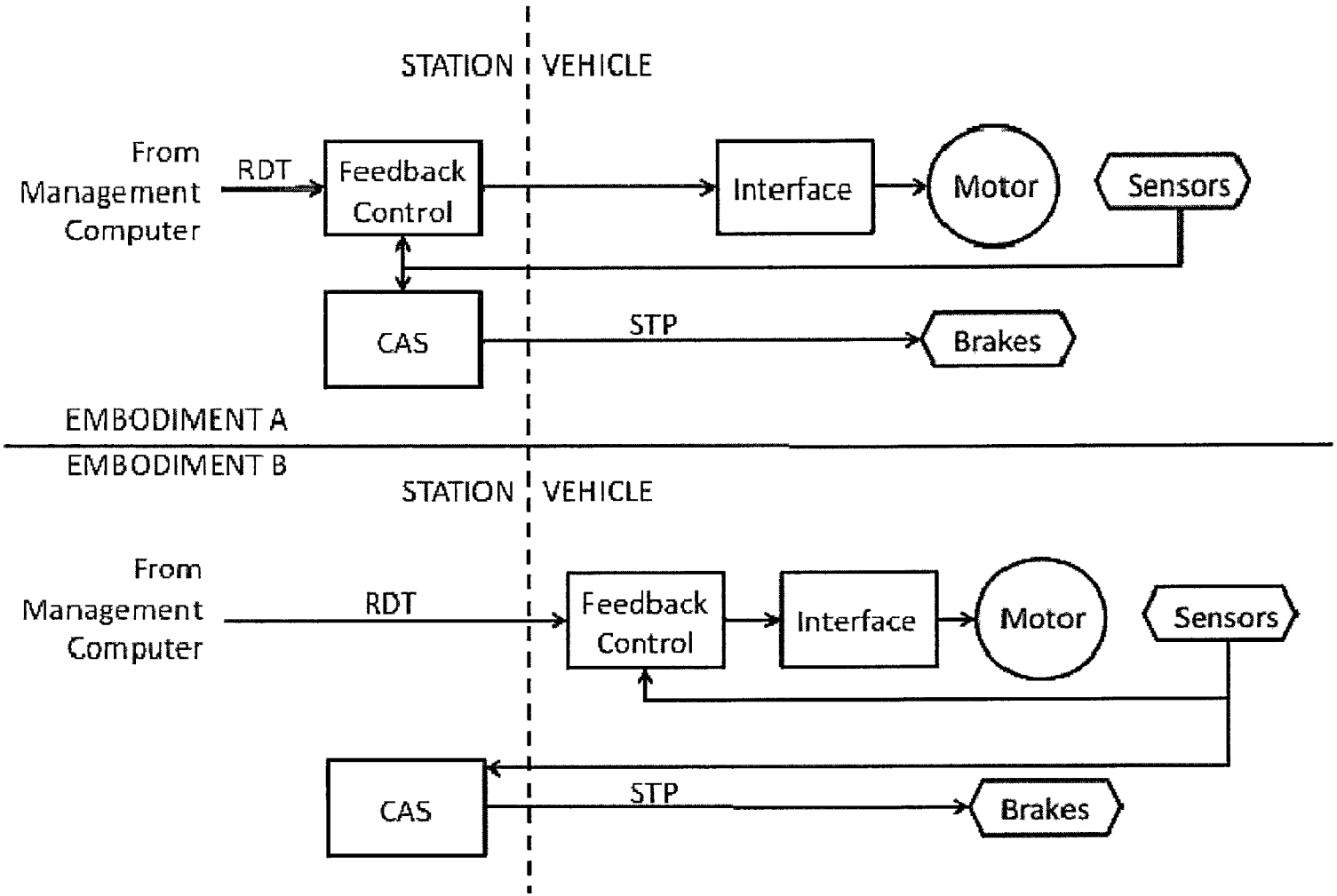
FIG. 8 are block diagrams illustrating alternative embodiments for implementing a control methodology according to aspects of the invention.

Another point to be made here is that there can be more than one embodiment of the methodology illustrated in FIG. 6. Two such possible embodiments are illustrated in FIG. 8. In Embodiment A, which is the embodiment described thus far, the closed loop control is implemented with the feedback control occurring in a computer 304 in the station. In this embodiment, the information sent from the station to the vehicle are either the actual force commands (in our example PWM commands) or incremental correction commands that convey a need to increase or decrease the controlling command to the motor. In Embodiment B, the close loop control is implemented with the feedback control occurring on the vehicle 306. In this embodiment, the information sent from the station to the vehicle would be the run definition file from which the vehicle-borne computer could generate target positions and execute closed loop control entirely from on board the vehicle. In both cases, a separate and independent collision avoidance system (CAS) would be implemented in the station and would be used to withhold braking on the vehicle with a safe to proceed command (STP) from the station when the station determines that it is safe to withhold braking. The relative advantages/disadvantages of the two embodiments are that Embodiment A requires less complex processing and equipment on the vehicle whereas Embodiment B can likely achieve a greater level of control given that the control loop can execute more frequently because it is not limited by the communication rate between the vehicle and the station.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. A method of controlling a vehicle in a transportation system, the method being implemented by a computer, the method comprising:

receiving a table that defines a trajectory for the vehicle, wherein the table comprises a plurality of jerk values, each of the jerk values having a corresponding time and a corresponding jerk duration;

computing, using the computer, a current target position for the vehicle based on the jerk values and corresponding times and jerk durations from the table, wherein computing the current target position includes synchronizing a current update interval to one of the corresponding times in the table of jerk values for the vehicle, wherein synchronizing includes:

determining a relative time difference between the current update interval and an initial time, identifying one or more jerk values in the table having corresponding times closest to the determined relative time difference, and using the identified one or more jerk values to develop the current target position;

receiving feedback from the vehicle about its actual position; and using the target position and the actual position to develop commands to cause the vehicle to follow the defined trajectory.

2. The method according to claim 1, wherein the using step includes:

calculating a position error using the actual position and the target position;

estimating a best guess command using the target position; and adjusting the best guess command using the position error.

3. The method according to claim 1, wherein the commands have values that each correspond to an expected velocity of the vehicle.

4. The method according to claim 2, wherein the using step further includes developing feedback terms using the calculated position error, wherein the feedback terms are used to adjust the best guess command.

5. The method according to claim 4, wherein the feedback terms are PID terms.

6. The method according to claim 1, wherein the steps are all performed in a system that is remote from the vehicle.

7. The method according to claim 1, wherein certain of the steps are performed in a system that is remote from the vehicle, and certain other of the steps are performed in the vehicle.

8. A system for controlling a vehicle in a transportation system, comprising:

a master computer, remote from the vehicle, that creates a table that defines a trajectory for the vehicle, wherein the table comprises a plurality of jerk values, each of the jerk values having a corresponding time and a corresponding jerk duration;

a computer remote from the master computer that receives the table and:

computes a current target position for the vehicle based on the jerk values and corresponding times and jerk durations from the table, wherein computing the current target position includes synchronizing a current update interval to one of the corresponding times in the table of jerk values for the vehicle, wherein synchronizing includes:

determining a relative time difference between the current update interval and an initial time, identifying one or more jerk values in the table having corresponding times closest to the determined relative time difference, and using the identified one or more jerk values to develop the current target position;

receives feedback from the vehicle about its actual position; and uses the target position and the actual position to develop commands to cause the vehicle to follow the defined trajectory.

9. The system according to claim 8, wherein the remote computer develops commands by:

calculating a position error using the actual position and the target position;

estimating a best guess command using the target position; and adjusting the best guess command using the position error.

10. The system according to claim 8, wherein the commands have values that each correspond to an expected velocity of the vehicle.

11. The system according to claim 9, wherein the remote computer further develops commands by developing feedback terms using the calculated position error, wherein the feedback terms are used to adjust the best guess command.

12. The system according to claim 11, wherein the feedback terms are PID terms.

13. The system according to claim 8, wherein the remote computer is entirely implemented in a system that is remote from the vehicle.

14. The system according to claim 8, wherein certain portions of the remote computer are implemented in a system that is remote from the vehicle, and certain other portions are implemented in the vehicle.

15. The method of claim 1, further comprising computing a current target velocity and a current target acceleration based on the jerk values and corresponding times and jerk durations from the table, such that the current target location, the current target velocity and the current target acceleration for a given point in time are all computed from one or more common jerk values from the table.

16. The system of claim 8, wherein the remote computer further computes a current target velocity and a current target acceleration based on the jerk values and corresponding times and jerk durations from the table, such that the current target location, the current target velocity and the current target acceleration for a given point in time are all computed from one or more common jerk values from the table.

* * * * *